US005611916A

United States Patent [19]

Laskowski et al.

[11] Patent Number: 5,611,916

[45] Date of Patent: Mar. 18, 1997

[54] AQUEOUS COMPOSITION USEFUL IN ORE FLOTATION CONTAINING ALIPHATIC AMINE

[75] Inventors: Janusz S. Laskowski, Richmond; Qun Wang, Vancouver, both of Canada

[73] Assignee: The University of British Columbia, Canada

[21] Appl. No.: 545,054

[22] Filed: Oct. 19, 1995

Related U.S. Application Data

[63] Continuation of Ser. No. 249,513, May 26, 1994, abandoned.

[51] Int. Cl.[6] ..... B03D 1/01; B03D 1/02

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 2,288,497 | 6/1942 | Tartaron . | |
| 2,689,649 | 9/1954 | Atwood . | |
| 2,937,751 | 5/1960 | Schoeld . | |
| 3,424,310 | 1/1969 | Wilson | 209/166 |
| 3,444,090 | 5/1969 | Michal | 252/312 |
| 3,596,763 | 8/1971 | Berthon et al. | 209/166 |
| 5,175,370 | 12/1992 | Fruth et al. | 564/493 |
| 5,231,228 | 7/1993 | Fruth et al. | 564/463 |

*Primary Examiner*—Thomas M. Lithgow
*Attorney, Agent, or Firm*—Richard P. Fennelly; Louis A. Morris

[57] ABSTRACT

A composition, adapted to be used in the beneficiation of coarse potash ore fractions in the substantial absence of extender oil, which consists essentially of: (a) water; and (b) a long chain primary aliphatic amine, for example, a tallow-based amine, having an iodine value of from about 20 to about 70 cg/g, preferably from about 40 to about 60 cg/g. The composition may further contain an acid to assist in the dispersion of the amine in water.

8 Claims, No Drawings

AQUEOUS COMPOSITION USEFUL IN ORE FLOTATION CONTAINING ALIPHATIC AMINE

This is a continuation of application Ser. No. 08/249,513 filed May 26, 1994 now abandoned.

BACKGROUND OF THE INVENTION

General practice in potash ore flotation aims at maximum recovery of coarse sylvite (KCl) particles. Depending on sylvite grain size, the potash ores are ground to either −6 mesh (3.36 mm) or −8 mesh (2.38 mm) and are classified into +20 mesh (0.85 mm) coarse and −20 mesh fine streams. In order to achieve maximum recovery of the coarse particles, these two are reagentized separately and then are usually floated together. The recovery of coarse potash particles is generally low.

Long chain primary amines are exclusively used by industry in the flotation of sylvinite ores. Extender oils, which are generally petroleum production heavy residue by-products, are used to assist the flotation of coarse fractions. Since these extender oils are usually carcinogenic due to their polycyclic aromatic components, much effort has been devoted to seek low carcinogenic replacements [J. S. Laskowski and Q. Dai, Proc. 18th Int. Mineral Processing Congress, Sydney, 1993].

Since the Krafft points of long-chain amines in brine significantly exceed temperatures at which commercial potash flotation plants operate (10°–35° C.), amines in brine appear in the form of colloidal species [J. S. Laskowski, Flotation of Potash Ores, Reagents for Better Metallurgy (P. S. Mulukutla, ed.), SME, Littleton, 1994, pp. 225–243] and the interaction of sylvite particles with such species determines flotation efficiency. To ensure good flotation, colloidal amine has to be well dispersed in brine.

DESCRIPTION OF THE INVENTION

The present invention relates to a novel composition, adapted to be used in the beneficiation of coarse potash ore fractions, in the substantial absence of extender oil, which consists essentially of: (a) water; and (b) a long chain primary amine having an iodine value of from about 20 cg/g to about 70 cg/g, preferably about 40 cg/g to about 60 cg/g. Optionally, the composition may also comprise an acid to assist in the dispersion of the amine in the water.

The long chain primary amine has the general formula $RNH_2$, where R is a long chain group of $C_8$ to $C_{22}$ carbon atoms having some intermediate degree of unsaturation as measured by iodine number. As is well known in the art, the iodine number (a measure of the consumption, in grams, of iodine per 100 grams of substance) is a measure of the unsaturation of that substance. Substantially hydrogenated primary amines will have low iodine numbers (e.g., up to about 10–15 cg/g) whereas unhydrogenated primary amines having a high degree of unsaturation in their hydrocarbyl substituent will have much higher iodine numbers (e.g., over about 70 cg/g). The amines selected for use herein have intermediate values as described above and can be most easily formed by mixing suitable weight amounts of the low and high iodine number amines just described or by selecting natural products, such as tallow amines, and suitably hydrogenating such a high iodine number material to achieve the desired iodine number. In any case, the term "long chain primary aliphatic amine" is to be construed as reading upon such an amine reagent if either in a form of mixed amines or in the form of a suitably hydrogenated amine having an original, high level of unsaturation.

The amount of the desired amine in the aqueous composition can be varied from about 0.1% to about 10%, by weight of such formulation.

Optionally, the aqueous formulation containing the previously described amine of the desired, intermediate iodine value can contain from about 0.1% to about 5%, by weight, of an acid to assist in dispersion of the amine in the water. Either carboxylic acid (e.g., acetic acid) or a mineral acid reagent (e.g., hydrochloric acid) can be selected.

The Examples which follow set forth additional embodiments of the present invention.

EXAMPLE 1

This Example illustrates the effect of the iodine value of a long chain primary amine on flotation of coarse potash fractions. A coarse fraction (−3.5+18 mesh or −5.6+1.0 mm) containing 35.9% KCl, 60.8% NaCl and 1.5% water-insoluble-minerals was prepared from a sylvinite ore A by screening.

The tests were carried out using a flotation column following conditioning the potash particles in brine with 10 g/t carboxymethyl cellulose, 50 g/t amine, and 167 g/t methyl-iso-butyl carbinol (MIBC) successively for four minutes. The amines with different iodine values used in the tests were neat or blended amine compositions formulated from commercially available products: (1) hydrogenated tallow amine (ARMEEN HTD brand from Akzo Chemicals Inc.) having an iodine value of 3.0 cg/g; (2) unhydrogenated tallow amine (ARMEEN TD brand, also from Akzo) and (3) oleic amine (ARMEEN OLD-C brand, also from Akzo) having an iodine value of 91.6.

All of the amines were predispersed in aqueous compositions with acetic acid as the emulsifier. Results shown in Table I reveal that good flotation recovery of the coarse potash fractions can be achieved with moderately saturated tallow amines with an iodine value of 40–70 cg/g without the use of any extender oil. The flotation recovery obtained with the use of unhydrogenated tallow amine (ARMEEN TD) was especially high:

TABLE I

| ARMEEN HTD/ ARMEEN OLD-C Ratio | Iodine Value (cg/g) | Recovery (%) |
|---|---|---|
| 10:0 | 3.0 | 48.1 |
| 9:1 | 11.9 | 49.2 |
| 8:2 | 20.7 | 48.2 |
| 6:4 | 38.4 | 76.6 |
| 5:5 | 47.3 | 69.8 |
| 4:6 | 56.2 | 65.6 |
| 2:8 | 73.9 | 56.1 |
| 0:10 | 91.6 | 13.7 |
| ARMEEN TD Alone | 44.6 | 89.7 |

Concentrate grades were 97 ± 1%.

EXAMPLE 2

Flotation of coarse fractions of four sylvinite ores was tested using the flotation column and the aqueous composition of an unhydrogenated tallow amine (ARMEEN TD) following the procedure described in Example 1. Using the method of the present invention, high recoveries were obtained, except for sample C (Table II):

TABLE II

| Sample | | | Concentrate | | |
|---|---|---|---|---|---|
| Sample (Size Range) | KCl (%) | Water-Insoluble Minerals (%) | ARMEEN TD (g/t) | Grade (% KCl) | Flotation Recovery (%) |
| A (−3½ + 18 mesh) | 35.9 | 1.5 | 100 | 96.9 | 94.5 |
| B (−6 + 18 mesh) | 33.4 | 6.8 | 200 | 81.5 | 91.3 |
| C (−6 + 18 mesh) | 24.5 | 3.9 | 200 | 95.4 | 49.5 |
| D (−6 + 18 mesh) | 38.6 | 2.3 | 50 | 83.2 | 77.9 |

The foregoing Examples, since they represent only certain embodiments of the present invention, should not be used to restrict the scope of protection to be accorded to that invention. The scope of protection sought is set forth in the claims which follow.

We claim:

1. An aqueous predispersion flotation composition, adapted to be used in the benefication of coarse potash ore fractions, in the substantial absence of extender oil, which consists essentially of: (a) water; and (b) from about 0.1% to about 10%, by weight of the composition, of a long chain primary aliphatic amine having an iodine value of from about 20 to about 70 cg/g.

2. A composition as claimed in claim 1 wherein the amine is a tallow-based amine.

3. A composition as claimed in claim 1 which further contains from about 0.1% to about 5%, by weight, of an acid to assist in the dispersion of the amine in the water.

4. A composition as claimed in claim 3 wherein the acid is a carboxylic acid.

5. A composition as claimed in claim 3 wherein the acid is a mineral acid.

6. A composition as claimed in claim 1 wherein the iodine value is from about 40 to about 60 cg/g.

7. A composition as claimed in claim 4 wherein the acid is acetic acid.

8. A composition as claimed in claim 5 wherein the acid is hydrochloric acid.

* * * * *